US006109469A

United States Patent [19]

Clive-Smith

[11] Patent Number: 6,109,469

[45] **Date of Patent: *Aug. 29, 2000**

[54] FREIGHT CONTAINER

[76] Inventor: Martin Clive-Smith, 66 Leam Terrace, Leamington Spa, CV31 1BO, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/549,043

[22] Filed: Oct. 27, 1995

[51] Int. Cl.[7] ..... B65D 25/00

[52] U.S. Cl. ..... 220/1.5; 220/23.2; 220/650

[58] Field of Search ..... 220/650, 1.5, 23.2, 220/23.4, 648

[56] References Cited

U.S. PATENT DOCUMENTS

| | | | |
|---|---|---|---|
| 2,170,525 | 8/1939 | Ball | 220/650 |
| 2,675,940 | 4/1954 | Schmitz | 220/650 |
| 3,047,189 | 7/1962 | Paul | 220/650 |

FOREIGN PATENT DOCUMENTS

| | | | |
|---|---|---|---|
| 2261640 | 5/1993 | European Pat. Off. . | |
| 1028278 | 5/1966 | United Kingdom . | |
| 2227480 | 8/1990 | United Kingdom | 220/650 |

*Primary Examiner*—Joseph M. Moy
*Attorney, Agent, or Firm*—Ladas & Parry

[57] ABSTRACT

A freight container comprises a profile defined between outer surfaces of corner fittings and a pair of opposed walls. Each wall has a plurality of elongated outwardly extending vertical members extending outwardly beyond the profile and the vertical members of one wall align with the spaces between the outwardly extending vertical members of the opposed wall. The vertical members are fixed to the top and bottom rails of the container and tapered toward the upper ends. The vertical members are terminated with a plate-like member covering the profile of the vertical members.

30 Claims, 7 Drawing Sheets

FREIGHT CONTAINER

This invention relates to a freight container, particularly but not solely for use in transporting goods abroad by sea.

In the field of freight containers there is always a demand to squeeze more cargo into each container. Various series of freight containers have been standardized over the years such that their overall dimensions are the same for any particular length of container, and handling devices known as corner fittings fixed at the extreme eight corners of an rectangular box shaped container define the maximum width, height and length of the container. Given these dimensions, the size of stowage cells on ships have been fixed to accommodate the containers as close together as is practical, and where there are no cells and containers are placed side by side on deck of a ship or in a container depot, these are placed side by side closely so as not to waste space.

A shipping container typically has a roof, base, front end wall, doors at the rear, and side walls. The side walls are these days made from steel sheet corrugated into vertical members or sections, although in the past there were many container walls comprising flat sheets of aluminium, steel or other cladding supported on vertical members running from roof to base. The width of these wall constructions subtracted from the overall width of the container thus set the internal cargo width of the container. Pallets onto which cargo is placed for handling and loading into containers are today manufactured to fit this internal width almost exactly, typically being two pallets to one internal width of the container.

However, in recent times it has been desired to increase the internal width of the containers to accommodate a larger size of cargo pallet, yet maintain structural ability of the walls and still allow containers to be closely stowed beside one another. Solutions to this problem have been devised and described in European patent application 0206542 by providing very slender door end frame members, and slender side wall structures. The problem with the slender frame members is that when the doors of the container are open for cargo loading, the frame is very flexible and needs special care. Indeed if there is another container stacked upon the slender framed container, only one door may be opened to prevent its structural collapse. Further, the slender walls necessitate extra weight of wall, and specially shaped corrugations which have to be used are expensive to repair and manufacture.

There is also the problem of internal length and it is desirable sometimes to increase the internal length of the container. This has been achieved in the past by making the door end frames slender mentioned as above, and setting back the position of the doors from the more conventionally accepted position. In moving the door back, problems of sealing the doors against water ingress to the flexible door end frames has become a serious problem.

It is believed that if the above problems could be overcome, more shipping lines would be interested in buying higher cubic capacity containers.

It is an object of the present invention to substantially mitigate these disadvantages.

The present invention provides a freight container having a profile defined between outer surfaces of corner fittings of the container, comprising a pair of opposed walls each having a plurality of elongate outwardly extending members which extend outwardly beyond the said profile and longitudinally in a vertical direction, and the members of one wall align with spaces between the outwardly extending members of the opposed wall.

In one embodiment of the present invention the outwardly vertically extending members are an integral part of the wall.

In an alternatively embodiment according to the present invention the outwardly extending vertical members are separately attached to the wall.

In either embodiment the outwardly extending vertical members are fixed to top and bottom rails of the container.

Preferably, the outwardly extending vertical members taper towards at least one their upper or lower ends, preferably within the said profile of the container. Conveniently, the outwardly extending vertical members are at least partially terminated with a capping piece, preferably a forged wedged shape block, or a plate covering the profile of the outwardly extending vertical member fixed to or formed as part of the top and/or bottom, or side rail.

Preferably, one or two corner posts of the container are smaller than the other of the corner posts. Conveniently, the smaller post is of a slender plate like construction and the other corner post is of an enlarged rectangular structure. The profile of the end corner posts conveniently does not project substantially into the cargo space within the container and beyond the inner face of the door of the container.

Preferably, seal faces of the door and corner posts and side rails include a sloping face located between one surface to another of the door end corner posts and side rails.

In a further alternatively embodiment of the present invention the top and bottom rails preferably are arranged to project outside the profile of the container and the outwardly extending vertical members project beyond the top and bottom rails.

Preferably, the door or doors of the container are hinged to a door end post by a double hinge arrangement which conveniently has two pivots, one to pivot the hinge and another to pivot the door relative to the hinge plate to allow the door to be opened and laid adjacent to the outside of the container.

In another preferred embodiment of the present invention the pitch of the corrugation of the walls is selected to minimize the length of a flat zone at each corner post to allow the container to be located in a cell guide of a stowage location.

The outwardly extending vertical members of the walls are preferably of a smaller depth in a central intermediate position along the length of the wall than the remainder of the outwardly extending vertical members of that wall.

Preferably, one or more outwardly extending vertical members are removed from an intermediate central location along a wall of the container.

Conveniently, the lengthwise clearance between adjacent stowed containers is at least twice the transverse clearance between said containers. Preferably, the top and bottom rails can be set closer together than a standard setting for the container to enable outwardly extending vertical extending members of a greater depth to extend from the walls of the container.

A rubbing strip can be located in the region of the floor of the container for guiding pallets loaded into the container. The rubbing strip conveniently is an extension of a bottom rail of the container and extends in a vertical direction. Strengthening members are preferably attached to the external surface walls of the container, with the strengthening members extending over and outwardly extending vertical member of one wall and on the opposed wall attached to the external surface of a space between outwardly extending vertical members, which space is aligned with the outwardly extending vertical member having the strengthening member attached thereto. Conveniently, an end cap is integrally formed in the side rail to protect the extreme outer ends of the vertical member.

Preferably, an outer side face of a corner fitting at one end of a container has a buffer plate attached to it to reduce the width between stowed container at the corner fittings. Conveniently, a diagonally opposite corner fitting of a container is also provided with a plate for reducing the width between stowed containers.

The present invention further provides a container with increased door end frame rigidity characterized by one of the two corner posts being slender and the other being substantially more bulky.

Embodiments of the invention will now be described by way of example with reference to the accompanying drawings, in which.

Figure 1:
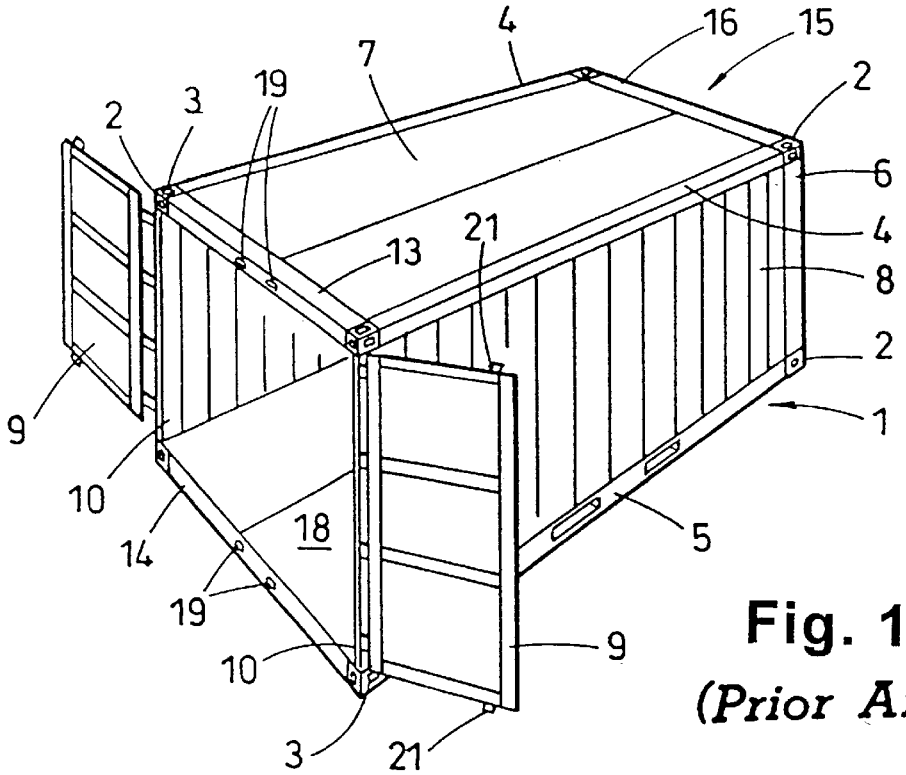
Fig. 1 (Prior Art)
FIG. 1 is a perspective view of a typical shipping container.

In FIG. 1 there is shown a perspective view of a typical rectangular box shaped shipping freight container 1 having at each corner a standard ISO corner fitting 2 comprising a rectangular box with elongate handling apertures 3 formed in each of its three outer faces. The corner fittings are located at the respective ends of a top rail 4 and a bottom rail 5 running lengthwise of the container on each side thereof. The top and bottom rails are spaced in a vertical direction by corner posts 6 and in a horizontal direction by a roof structure 7. Side walls 8 extend lengthwise of the container between the top and bottom rails 4, 5 and corner posts 6. Rear end doors 9 are mounted on rear end corner posts 10 for gaining access to the interior of the container. The door end frame comprises top and bottom end rails 13, 14 respectively and the corner posts 10 onto which the doors 9 are mounted.

The normal plan profile of a typical shipping container is defined by vertical planes 11 (FIG. 2) in which lie the outermost vertical faces of the corner fittings 2 beyond which no component part of the container projects.

In FIG. 1 side walls 8 are shown to comprise vertically corrugated steel sheets which connect to top rail 4 and bottom rail 5. Front end wall 15 is again a vertically corrugated steel sheet and is supported by a peripheral frame comprising top rail 16, posts 6 and a bottom rail not seen. The roof 7 comprises a steel sheet either flat or corrugated supported by a peripheral frame comprising top rails 4, 16, 13. A floor 18 comprises timber planks or other suitable material supported between the bottom rails 5.

It is to be noted that no part of the container projects outside the rectangular envelope formed by the horizontal and vertical planes in which the three outermost faces of the corner fittings 2 lie. The width of a major side frame of the container 1 is defined by the outermost faces of the top rails 4 and bottom rails 5 which in most containers fall just inside the overall width defined by the corner fittings 2, but in some other containers might lie outside the overall width defined by the corner fittings 2.

Figure 2:
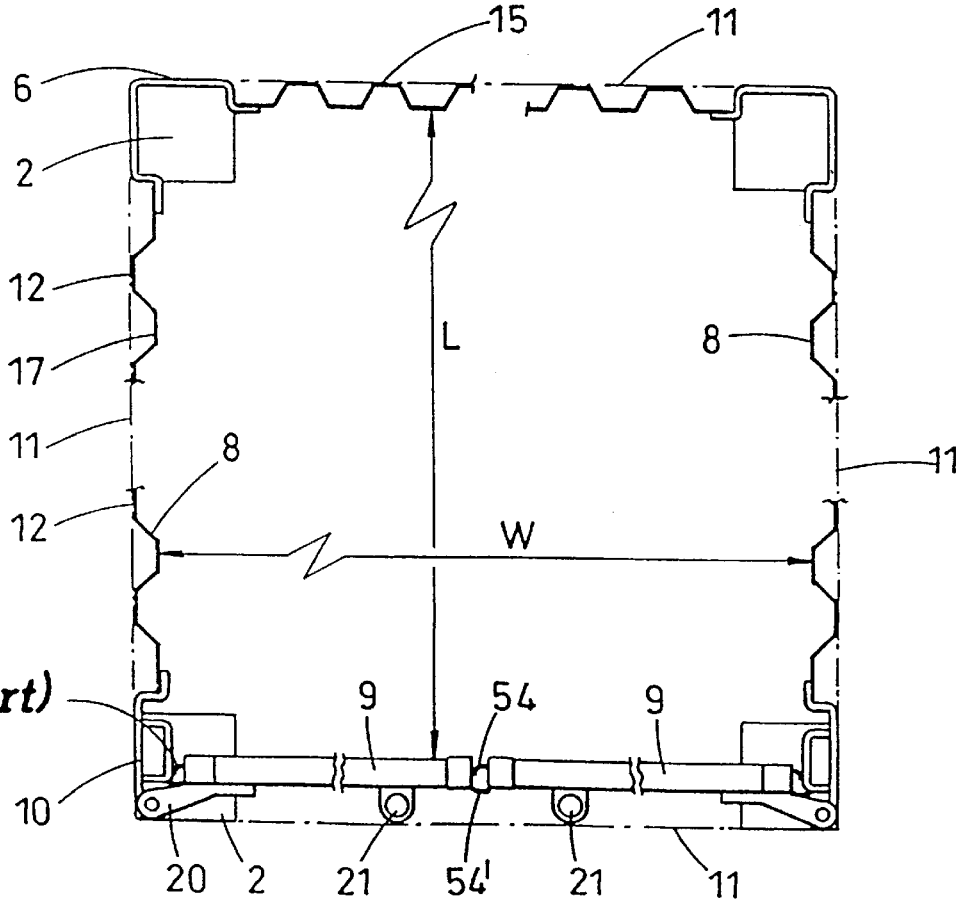
Fig. 2 (Prior Art)
FIG. 2 is a plan section with enlarged detail of a typical known shipping container.

FIG. 2 is an enlarged cross-sectional plan view of the typical freight container 1. The side walls 8 and end wall 15 lie recessed back from the plane 11 which contains the outer vertically extending faces of corner fittings 2. The internal width is denoted by arrow W and internal length by arrow L. Each corner post 6 comprises a pressed section to which wall 8 and end wall 15 are welded or otherwise attached. The shape of wall 8 seen in section is a typical trapezoidal corrugation having peaks 12 and valley shaped spaces 17 between peaks 12. The doors 9 are mounted on end posts 10 via hinges 20.

Doors 9 are locked relative to the bottom rail 14 and upper rail 13 by locking bars 21 which engage with known keepers 19 (seen in FIG. 1) attached to the upper and lower rails 13 and 14, respectively.

Figure 3:
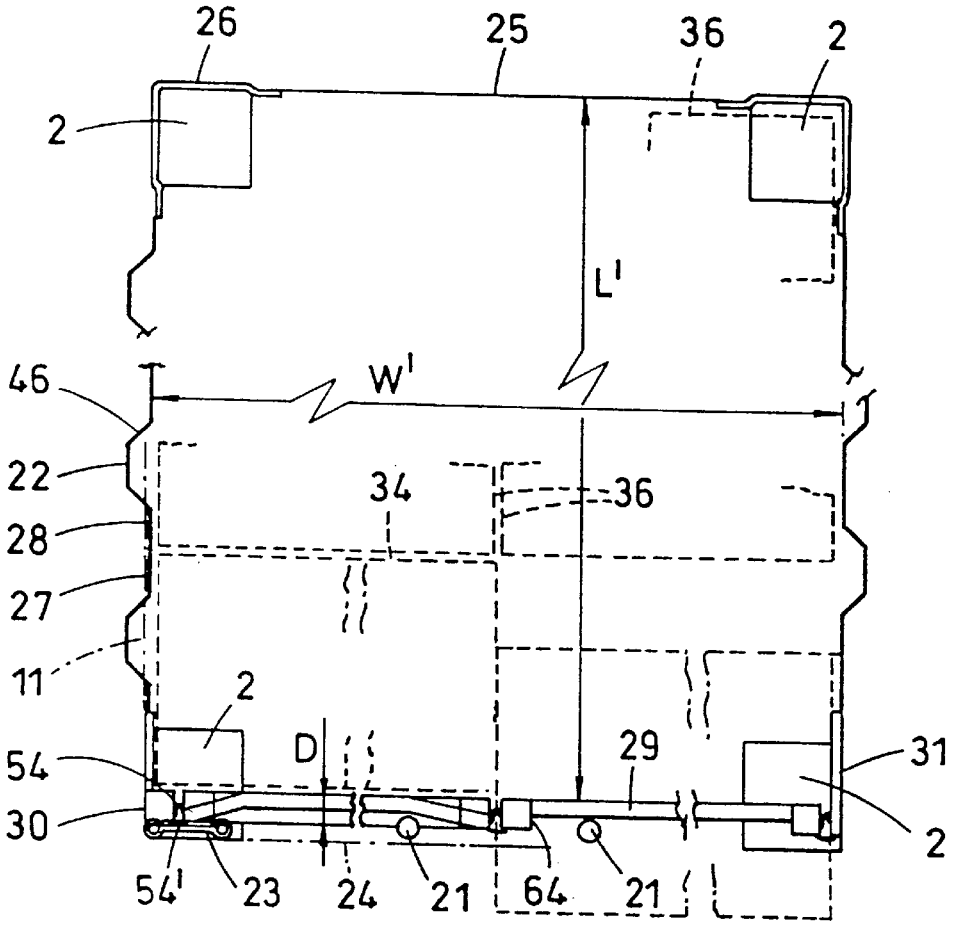
FIG. 3 shows a cross-sectional plan view with enlarged detail of a shipping container in accordance with the present invention.

FIG. 3 illustrates a similar view to that of FIG. 2 but shows a cross-sectional plan view of a shipping container in accordance with the present invention. Side wall 28 is similar in shape to side wall 8 of FIG. 2 being formed with trapezoidal corrugations comprising vertical members 46 having peaks 22 and spaces 27 therebetween formed within the steel (or other material) sheet which constitutes side wall 28. However, in this embodiment the peaks 22 project outside the profile plane 11 containing the outer vertical faces of corner fittings 2 resulting in the internal width W' being now greater than the width W of the shipping container shown in FIG. 2.

Front panel 25 in FIG. 3 s a flat sheet of steel and assists in defining an internal length L' of the container which is greater than length L of the container of FIG. 2. Each corner post 26 is an elongate right angled plate having sides 26*a*, 26*b* of equal length with an inwardly extending recess 26*c* at each free edge 26*d* thereof to receive and fix therein one partial side edge of side wall 28 and front wall 25 so as to optimize internal cargo space.

At an opposite rear end of the container there is located a left-hand post 30, a right-hand post 31 and two doors 29. The doors 29 are connected to the posts 30, 31 by hinges 23 which each have two pivots 32, 33. This construction will be described in more detail below. At this point it will be noted the hinge 23 allows the door 29 to be set further outwards closer to the plane 24 of the corner fittings 2 and thus increase the internal length L' of the container.

In this embodiment the rear left hand post 30 is shown to be wide relative to the thickness of the material forming the door but when the door 29 is closed as shown, the depth D of the post 30 does not substantially differ from the overall depth of the door and does not substantially project into the cargo space beyond the inner face of the closed door 29. The post 30 has an outer J-bar 67 shown more clearly in FIG. 8 which comprises a variety of suitable shapes or composite parts to suit structural requirements and interconnection requirements to wall 28 similar to the outer part of post 10.

Therefore, a pallet 34, shown as a dotted line of almost half the width W', can be placed inside the container to occupy the full half width W' without being restricted by the door 29 when it is closed or by the size of the post 30. The right hand post 31 is of a flat elongate plate rather than of a square box shape configuration of the left hand post 30 in FIG. 3. To load a second pallet 35 next to pallet 34, pallet 34 is placed inside the container first and moved to the left past post 30. Pallet 35 can then be loaded through the remaining half width of W' which exists substantially between pallet 34 and post 31 accepting that there is a small restriction caused by the position of post 31 being inboard of the wall 28. This is normally acceptable since the majority of pallets 36 will have already been loaded into the main body of the container where there is full width W'.

Figure 4:
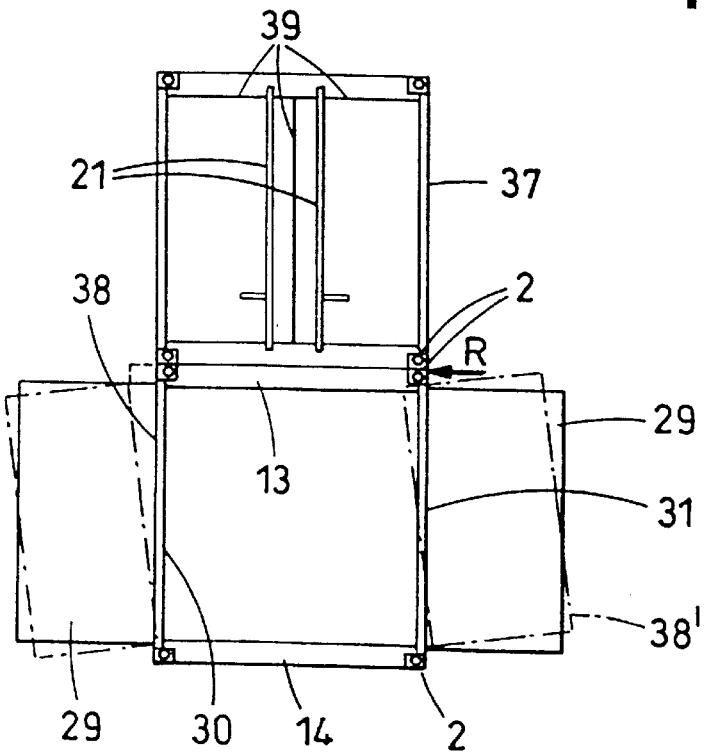
FIG. 4 shows an end elevation of one shipping container located upon another.

In FIG. 4 there is illustrated a door end frame 38 comprising top rail 13, bottom rail 14, left hand rear post 30, and right hand rear post 31 with doors 29 open. If there should be any racking force denoted by arrow R such as might be caused by the stacking of a container 37 on top of the present container placed on sloping ground, then the door end frame 38 tends to deflect as illustrated by dotted line 38' making operation of the doors 29 difficult. However to stiffen the door end frame 38 against such movements, the posts 30, 31 would ideally be made as rigid and bulky as conventional container corner posts 10 which are known to prevent the deflection indicated by arrow R from being too great for manual operation. The space requirements of the present invention prohibit the posts 31 from being as rigid as desired. However, this can be overcome by making left hand post 30 of greater depth as viewed in plan across the width of the container and this can compensate for the slender and potentially more flexible right hand post 31.

Figure 5:
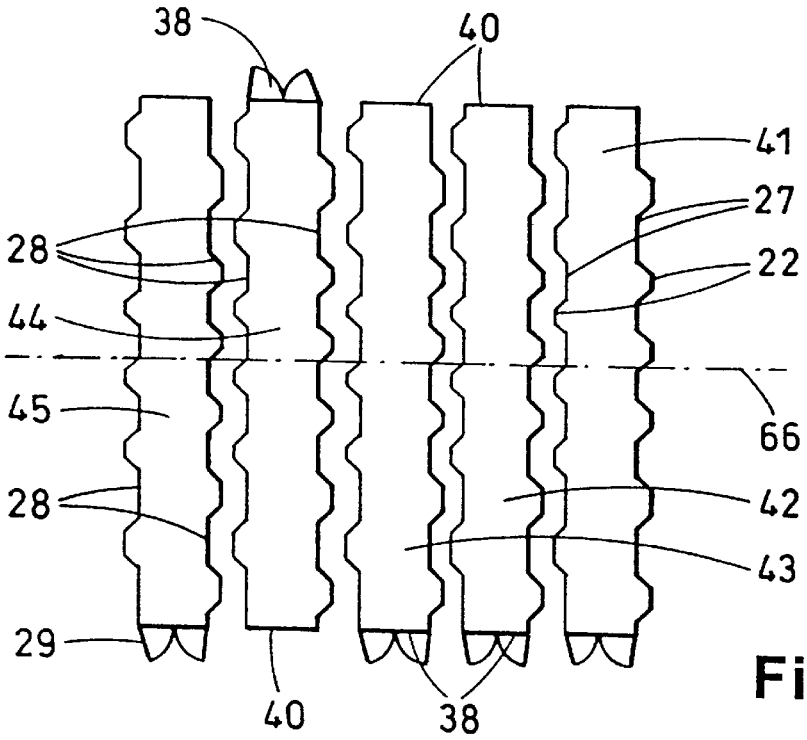
FIG. 5 shows a diagrammatic plan view of several of the containers of FIG. 3 placed side by side in line.

Referring to FIG. 5 there is shown a diagrammatic plan view of several containers 41, 42, 43, 44, 45 of the present invention placed side by side substantially in line as they might be in an efficient ship board stow, for example. There are typical requirements for the degree to which containers may be stowed out of line before contact of one container against another might be expected. Misalignment might typically be 25 mm and thus the space 27 between vertical members 46 would allow for such misalignment. However, greater misalignment than 25 mm might be tolerated or even desired. Known containers of shorter or longer lengths have standard ISO handling corner fittings 2 positioned at their ends or at intermediate positions. Thus when these containers are lined up with each other, at least one pair of the corner fittings 2 towards one end of the container are located substantially in line with corresponding corner fittings of the adjacent containers. Of course under certain circumstances it might not be necessary to have the containers stowed in line.

Each container has a left-hand wall 28, and right-hand wall 28' each of corrugated form with peaks 22 and recesses 27. The peaks 22 of the wall 28 of the container 41 are arranged to be aligned with the spaces 27 of the opposed wall 28' of the container 41. With such a construction the peaks 22 of the wall 28 of the container 41 are arranged to be offset relative to the peaks 22 of the wall 28' of the next adjacent container 42 with the rear door end frame 38 both at the same end such that the peaks 22 of the container 41 align with the spaces 27 of the container 42 and vice versa. As the containers are positioned closer together, the peaks 22 of one container pass those peaks 22 of an adjacent container until ultimately contact is made one container into the spaces 27 to another of the next adjacent container.

It is convenient in manufacture to make the assembly of wall 28 the same as wall 28' but on one container arrange the walls 28, 28' so that the peaks 22 of wall 28 align with the recesses 27 of the wall 28'. Therefore peaks 22 and spaces 27 of all side wall corrugations of the containers 41 to 45 whichever way they might be orientated, door end frame 38 to front end frame 40, and vice versa, likewise nest with the spaces and peaks respectively of its adjacent container. Therefore such containers 41 to 45 with such a pitch of peaks 22 and spaces 27 can be placed closely side by side without touching yet have vertical members 46, FIG. 3, of sufficient amplitude from peak 22 to space 27 to provide high strength and not encroach on the valuable cargo space within the container.

Where the peaks 22 of the vertical members 46 and the spaces 27 meet the top and bottom rails 4, 5 various configurations are envisaged. FIG. 5, shows that the peaks 22 of the container 43 do not encounter any projection on container 42, 44 at their spaces 27. FIGS. 6A, 6B, 6C and 7 illustrate various solutions to the connection where walls 28, 28' meet top rails 4, and bottom rails 5.

Figure 6A:
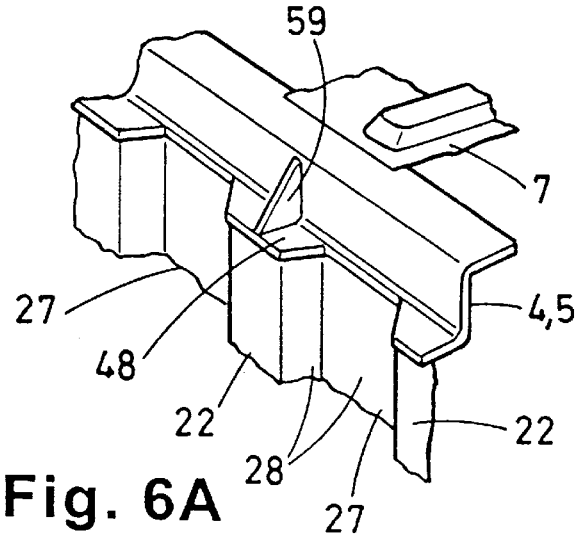
FIGS. 6A, 6B and 6C show in detailed perspective views of end caps for capping vertical members.

In the perspective view of FIG. 6A the top rail 4 is seen in partial detail and comprises a strong bar or pressing with flat capping pieces 48 extending perpendicularly from the bar to cover, terminate and shield ends of peaks 22 and an open hollow space 22' behind the peaks against the weather and should the rail 4 impact another container or the like which would otherwise damage the thinner wall sheet 28. Bottom rail 5 is shaped with similar inverted flat capping pieces 48 where wall 28 meets rail 5. The perpendicular projections might be formed as part of the rail 4, 5 or fixed by welding etc. on to a separate pressing. A buffer plate 59 integral with capping pieces 48 serves to deflect away any impacting rail from the wall 28 of the container.

Figure 6B:
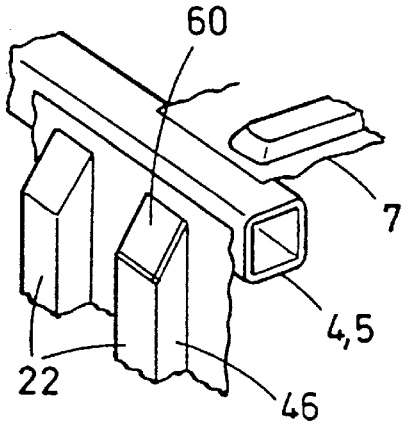

In FIG. 6B each of the vertical members 46 is constructed at its uppermost end to taper off towards a hollow box section upper rail 4 so that the whole of the upper rail remains back from the peaks 22 of an adjacent container such as container 43 might be to container 44 in FIG. 5. A similar connection is made to the bottom rail 5. A capping piece 60 comprises a reinforcing plate fixed by welding etc. to the sloping part of member 46 to resist damage to peak 22 especially where the vertical member defining the peak is pressed from part of a thin sheet of steel forming the wall 28.

Figure 6C:
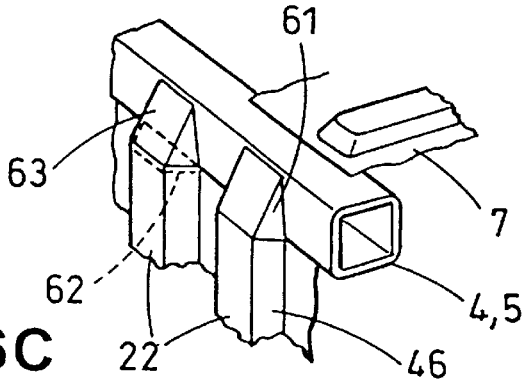

In FIG. 6C the vertical member 46 is capped off using a forged or pressed capping piece 61 which is wedge shaped to guide off any impacting member. The capping piece 61 acts as a buffer and is conveniently formed, by hot forging, with a lip 62 shown in dotted line which is self locating within the trapezoidal shaped vertical member. The capping piece 61 has a bottom plate also denoted by dotted line 62 which closes off that which would otherwise be a cavity formed between sloping face 63 and rail 4, 5. Alternatively the capping piece 61 can be made of a solid material, such as steel, aluminium etc.

The vertical members described in the various Figures of the drawings are each located relative to the bottom rail(s)

of the containers at a height from the very bottom edge of the containers which ensures the bottom of the vertical members and their respective end caps do not engage fixed locators which are provided on the deck of ships or even at quaysides and which locators serve to act as guides for locating a container directly on the deck or quayside, for example.

The locators can be a large flat block of metal such as steel upstanding from the deck or quayside, having an upper longitudinal edge which is sloped downwardly to assist in guiding the container into its correct position. The locators can take other shapes such as a T-shape, right-angled shape with arms of equal length or a cross for example. For each of these shapes the locators are of the greatest height 20.32 cm (8 inches) at the connection between the arms thereof and slope downwardly and outwardly towards the free outer vertical edge of each arm to a height of approximately 12.7 cm (5 inches).

Figure 7A:
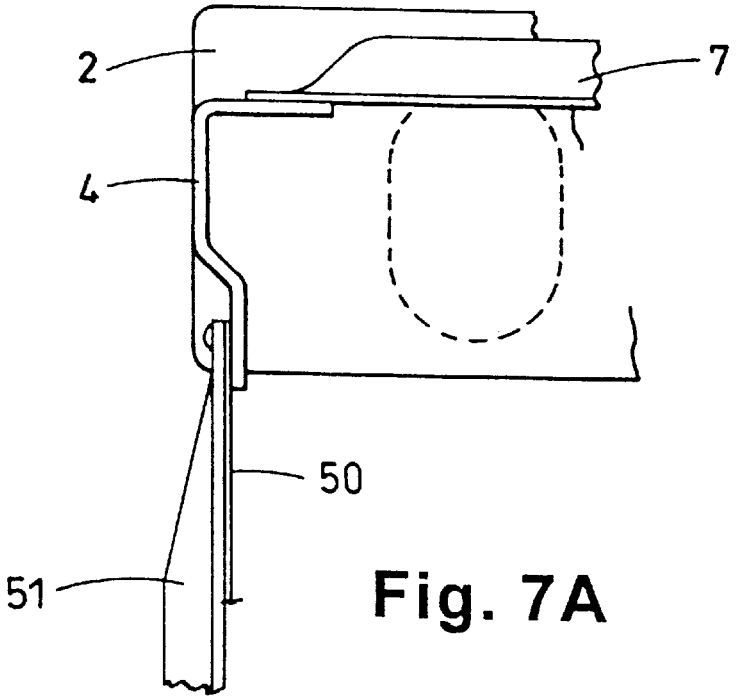
FIGS. 7A and 7B show a detailed partial elevational view and a cross-sectional plan view of an alternative form of vertical member in relation to a corner fitting.
Figure 7B:
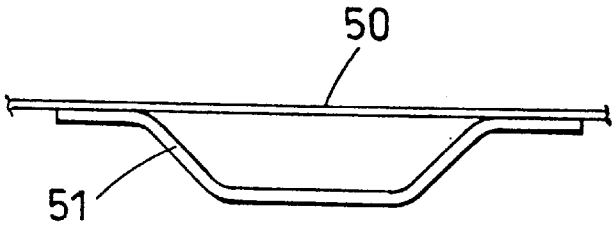

Referring to FIG. 7 there is illustrated another form of container side wall comprising a flat sheet 50 which can be of steel, aluminium, plywood or other suitable material, fixed to an elongate angled plate 4' of top rail 4 which extends from corner fitting 2 by rivets welding, or other means (not shown). The side wall sheet 50 by itself is not entirely strong enough for operational use in the shipping container environment, and additional vertical members 51, in this embodiment not formed as part of the sheet 50 although may be so, are provided for additional support. The vertical members 51 comprise, for example, pressed steel or extruded aluminium sections which can either be fixed by welding, rivetting, adhesive or other known means, or be free from fixing, to the sheet 50. The vertical members 51 are fixed to the rails by welding, rivetting or other known means. The shape of the vertical members 51 is seen to taper off to a closed end near the rails 4 5 so as not to present an abutment to any obstructions or other container being moved into position adjacent to it.

Figure 14:
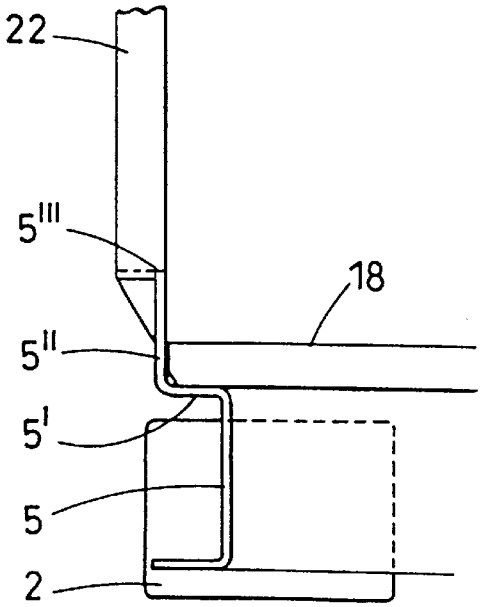
FIG. 14 is a cross-sectional side elevation illustrating the presence of a rubbing strip as part of a side rail.
Figure 15:
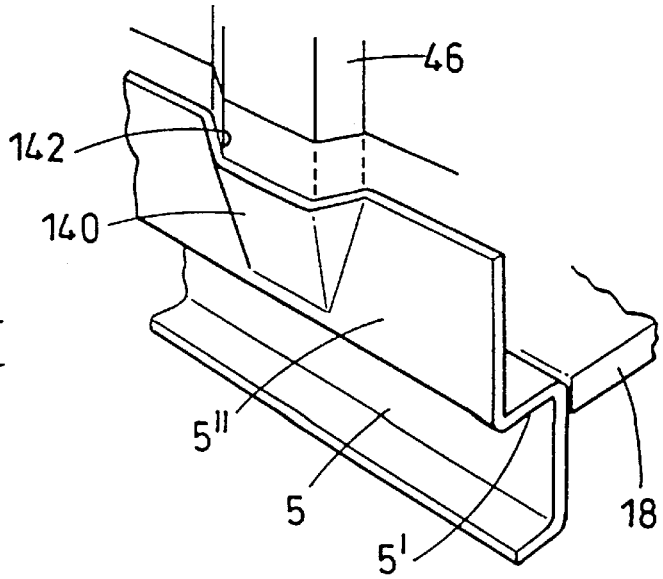
FIG. 15 is a detailed partial perspective view of a side rail having a cap integrally formed as part of the side rail.

The 'caps' at the ends of the corrugations can be formed as part of the side rails as is illustrated in FIG. 15 where the side wall, similar to that shown in FIG. 14 and a cap 140 is formed as an integral part of the rubbing strip 5" of the side rail 5. A post or vertical member 46 aligns with the cap 140 for welding thereto or preferably has a downward extension 141 which enters into opening 142 at the top edge of the guide rail. The cap 140 tapers inwardly towards the bottom of the rubbing guide 5". This saves an additional forged component and is welding. Although after forming, the edge of the rail would not necessarily be level the side panel can overlap the formed shape thus tolerating changes in level. It applies to top and bottom rails.

Figure 8:
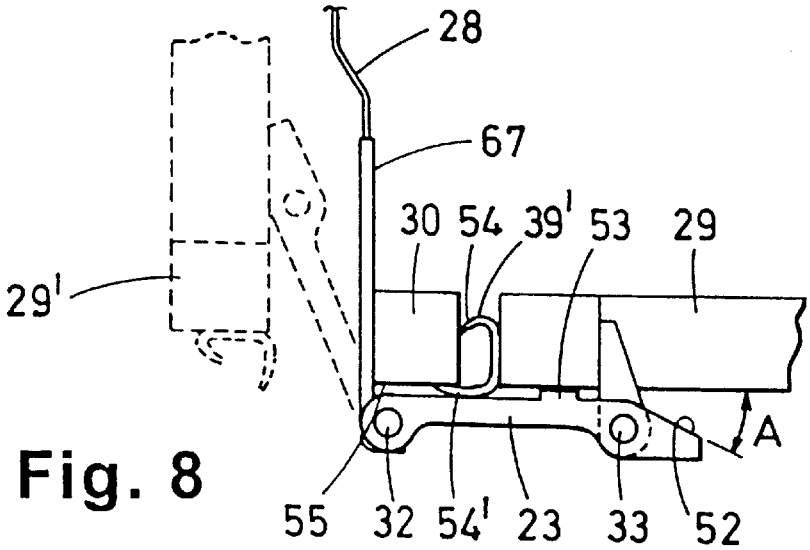
FIG. 8 shows a detailed sectional plan view taken through a door hinge of a container of the present invention.

In FIG. 8 there is shown a detailed plan view of double hinge 23 with a door 29 in a closed position. The hinge 23 has two pivots 32, 33. Pivot 32 allows the door 29 to rotate freely outwards through about 270 degrees. Pivot 33, however, is restricted in its motion and the door 29 can only rotate outwards through angle A until door 29 or an abutment attached to door 29 engages stop 52 and back again until the door engages stop 53. The purpose of stops 52, 53 is to ensure that the door sealing gasket 39' engages the corner post 30, 31 at the right angle during closing of the door 29. When the door 29 is fully open as in the position indicated by dotted line 29', the double hinge 23 has a sufficient degree of freedom to allow the door 29' to fold back against wall 28.

The double hinge 23 is not essential to the invention but illustrates a means of further increasing the internal length L' of the container. A conventional hinge 20 as shown in FIG. 2 will suffice for some containers.

Returning to FIGS. 2 and 3, the doors 9, 29 are shown in the closed position with vertically extending locking bars 21 engagable with rear end, upper and bottom rails 13,14. To weather seal the doors 9, 29 against the rear end door frame 38 there is typically a rubber gasket 39 which runs around the external peripheral edge of door 9, 29 as shown in FIG. 2 and, for example, in EPO 395640. Gasket 39 shown in section comprises a channel section with inner lip 54 and outer lip 54'. The outer lip 54' overlaps the surface of mating sections such as corner post 10 and rail 14. However, to make the door locking bars 21 and door 29 more compact to increase internal length L of the container gasket 39' in FIG. 3 the door, within the thickness of the door frame takes a different route from gasket 39. The locking bars 21 can be partially or fully recessed within the door frame itself as illustrated in FIG. 3 on the left hand door, or the door made slimmer adjacent the locking bars 21 relative to the vertical door frame members 64 of the right hand door 29 in FIG. 3.

In FIG. 8 an enlarged detail of the gasket 39' is shown with outer lip 54' contacting seal surface 55 of corner post 30.

Figure 9A:
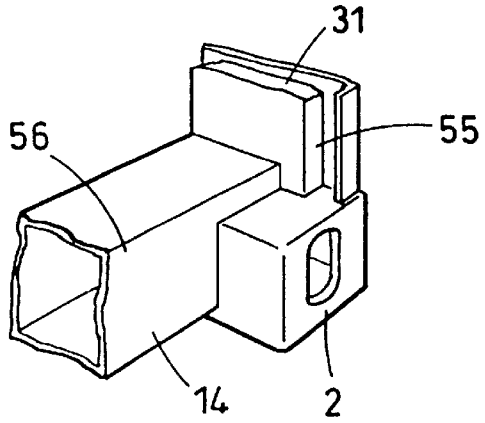
FIGS. 9A, 9B and 9C show various embodiments of modified end posts and side rails to ensure a door gasket joint seals efficiently where the gasket closes the gap between the door and adjacent door frame and side rails.

In FIG. 9A there is illustrated a perspective view of a bottom corner fitting 2 from which extends bottom end rail 14 also connected to a corner post 31. The door 29 is open and not shown. What is shown is a seal surface 55 of post 31 and a seal surface 56 of end rail 14 which do not lie in the same vertical plane. This discontinuity of the seal surfaces complicates the shape and routing of gasket 39' at this junction.

Figure 9B:
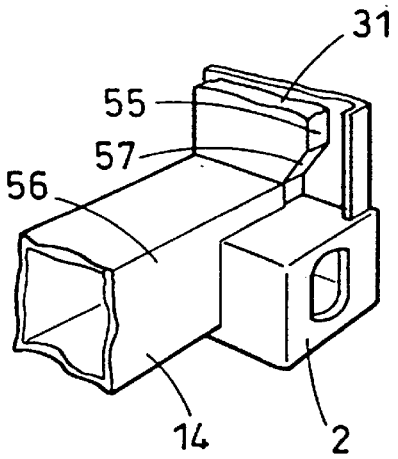

FIG. 9B shows a similar structure to that shown in FIG. 9A and the same reference numerals identify like parts. However, corner post 31 is shaped to provide a downwardly sloping seal surface 57 as shown in FIG. 9B which allows connection and continuity of surface for outer lip 54' of gasket 39'.

Figure 9C:
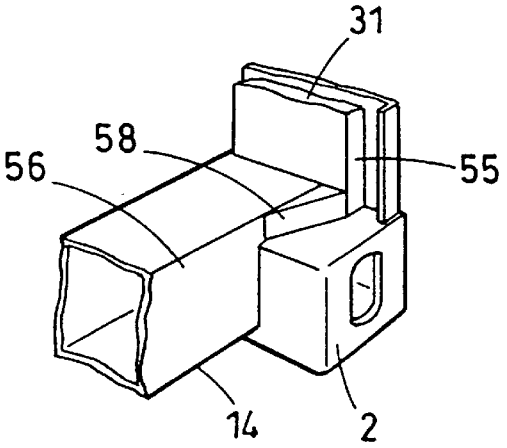

FIG. 9C again shows a similar structure to that shown in FIG. 9A and the same reference numerals denote like parts. In this embodiment the rail 14 rather than the corner post 31 is shaped to provide an outwardly sloping seal surface 58 which continues contact surfaces 56 outwardly to seal contact surface 55 and which allows continuity of seal surface from post 31 to end rail 14.

At the vertical joint where the two doors 29 meet, similar corresponding cooperative sloping surfaces in the outer structural members of the container such as the door 29, top rail 13, or end rail 14 are formed to provide a substantially continuous seal surface from one seal surface to another seal surface. Likewise top rail 13 and uppermost ends of corner posts 31, 30 have similar arrangements.

Figure 10:
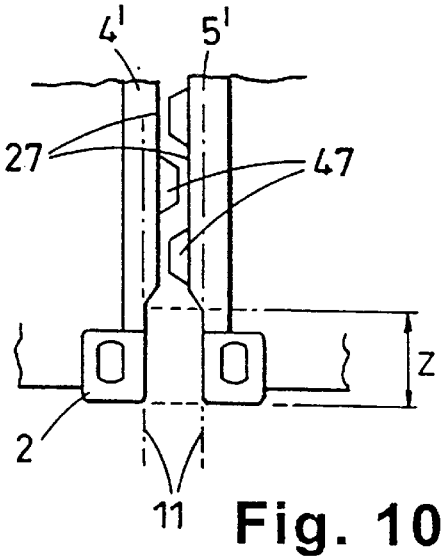
FIG. 10 shows a detailed partial plan view of one corner of each of two adjacent containers.

In FIG. 10 there is shown in partial detailed plan view upper rails 4', 5' and corner fittings 2 for two containers standing closely adjacent in line with one another. The rails 4', 5' are seen to project outwardly beyond vertical profile plane 11 as required in some types of extra wide containers. The vertical members 47 align as previously described in the spaces 27 of the next adjacent container.

It is to be noted that the end walls can be formed in similar fashion to the side walls in accordance with the present invention to enable containers to be close stowed in the longitudinal direction thereof and yet embody vertical members projecting beyond vertical plane 11. Therefore, in this respect, reference to end wall can be read as side wall and side by side is understood to include end to end.

Some other types of containers making use of the features of the present invention. These containers can have removable curtain 'walls' supported by removable vertical members, be cylindrical tank containers with stiffening rings which at some point the rings can project beyond the normal plan profile of the container, be platform based containers with no wall at all but have lashing devices such as removable stakes sitting in stake pockets as vertical members which might advantageously project beyond the normal plan profile of the container to increase the internal cargo space of the platform.

It is common for there to be containers of nominal length 1220 cm (40 ft) mixed with containers of 610 cm (20 ft) and less common to be mixed with containers of 305 cm (10 ft) and 915 cm (30 ft) long. Newer types of containers of other lengths such as 1372 cm (45 ft) are also emerging. Thus the position of the vertical members 46 has to be selected to enable containers of different lengths to be positioned with their ends lined up and to be compatible with one another these containers being positioned in orientations front adjacent front, front adjacent rear etc. It is calculated an optimum pitch of 248 mm allows compatibility of a 310 cm and 1120 cm container yet provides a minimum (300 mm) flat zone Z (FIG. 10) at one end of each side wall, diametrically opposed, adjacent to the corner posts for ensuring the containers clear a ships cell guides when being stowed. These flat zones in fact represent a weakness in the structure and thus by selecting the pitch of the corrugations to be 248 mm the length of the flat zones is limited.

Advantageously, the centre of the corrugated side wall of a 1229 cm container for example, can have shallower depth corrugations to allow clearance between say a 610 cm container's corner fittings placed adjacent to the 1220 cm containers. This is to ensure that the corner fittings 2 of the 610 cm container remain spaced by at least 9 mm between container side walls. Without such modification the peaks 22 of the 1220 cm container are spaced 2 mm from the adjacent corner fittings 2 of the 610 cm container which is too close.

Figure 11:
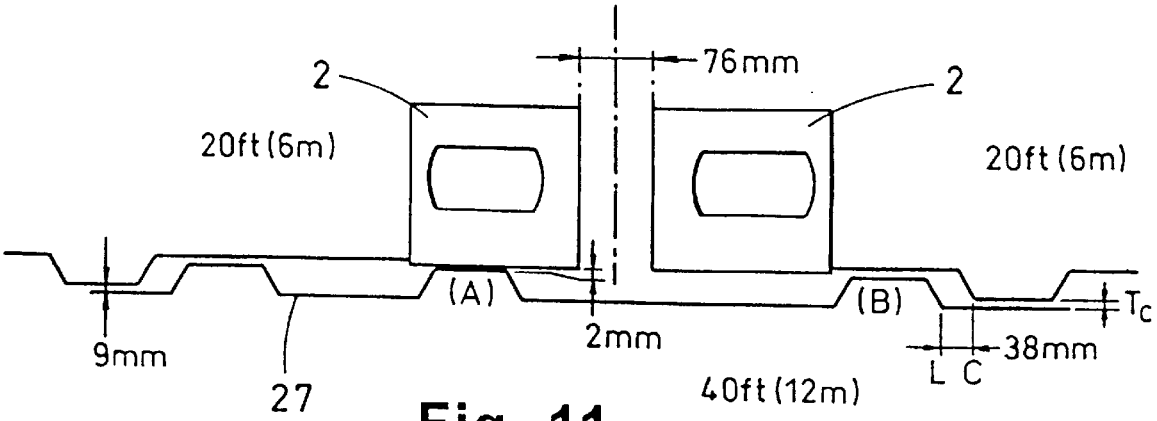
FIG. 11 is a detailed partial plan view of stowed containers of differing lengths.

FIG. 11 illustrates a detail of the relative positioning between say a 1220 cm container and two end to end 610 cm containers with their relative spacings in mm. As shown peak A of the longer container is separated by 2 mm from corner fitting 2 of an adjacent shorter container. To avoid this situation peaks A and B on the longer container can be reduced in depth or removed altogether to increase the gap between the sidewalls of the containers.

Certain stowage controls determine that containers do not in fact get close enough to hit transversely but there is more freedom longitudinally.

Modern day freight containers are made as light so as to achieve this feature the thickness of the wall structure has been reduced making it essential to ensure the side panels do not touch otherwise they can become severely damaged, even to the extent of being punctured.

Accordingly the greater the depth of corrugation for a given strength requirement the side panels can be made of thinner material. Moreover the spacing between containers during stowage is to be maintained carefully.

Figure 12:
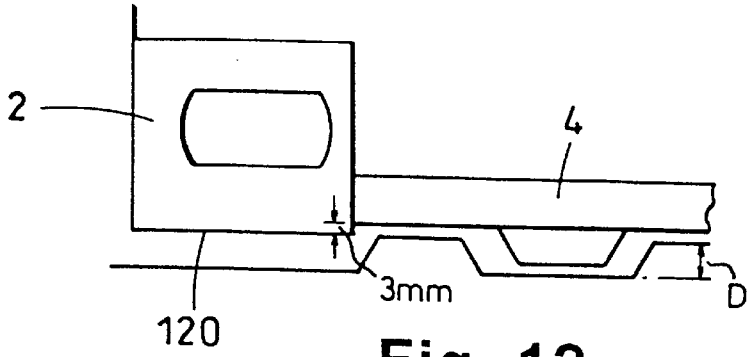
FIG. 12 is a detailed partial plan view of a corner fitting and a side rail of the container.
Figure 13:
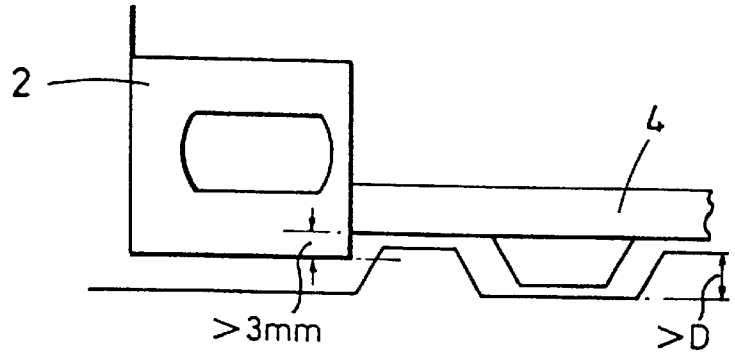
FIG. 13 is a modified partial plan view of a corner fitting and a side rail of the container.

The longitudinal upper and lower side rails of a standard container are usually set at the widest position allowable to maximise the internal width of the container, usually 3 mm inset from the corner fitting (FIG. 12), side wall datum 120. However, the side rails (FIG. 13) can advantageously be located inboard more than 3 mm (say 4 mm to 25 mm or more) from the corner fitting datum to allow the peaks 22 of the side wall corrugations to be increased in depth and to penetrate the subsequent increased depth of space 27 of an adjacent container in FIG. 13.

In one alternative embodiment of a shipping container according to the present invention the bottom side rails 5, as shown in FIG. 14 are each of an elongate rectangular U-shaped channel in which at one outermost free end of uppermost arm 5' there is an elongate plate 5" extending outwardly perpendicularly in a vertical direction from the arm 5'. The floor 18 of the container is supported on the innerside of arm 5' and a portion 5" of the extension 5" projects above the floor 18 to define a rubbing strip for guiding pallets as they slide across the floor 18. With such a construction the corrugated or planar sidewall panels are mounted on a top elongate edge 5'" of the rubbing strip as shown in FIG. 15.

The invention disclosed herein is equally applicable to a new container which is increasingly being used in the shipping container industry as container regulations alter within the European Community. The container referred to is a 1372 cm (45 ft) long container. Other containers longer than the 1220 cm (40 ft) container are possible and in such longer containers the corner fittings usually used to handle a 1220 cm long container would remain present with the same distances between them in the longer container which itself would have an extension at each end of approx. 76 cm (2.5 ft).

This of course leads to difficulty in stowing the larger shipping container within the usual guides provided on board ship, for example, because the containers will of course not fit the guides and therefore it is necessary to load these enlarged containers on deck or in holds without cell guides. The need to close stow one beside another but ensure no contact with the side walls is still a requirement with the stowage gap between two closely stowed containers being maintained typically at 25 mm between the vertical faces of two adjacent corner fittings. As far as the above described principle of corrugations is concerned in respect of the present invention, the container side walls would comply with the same requirement that the peaks of the corrugations on one side of the container would align with the spaces on the opposite side wall of the container.

Figure 16:
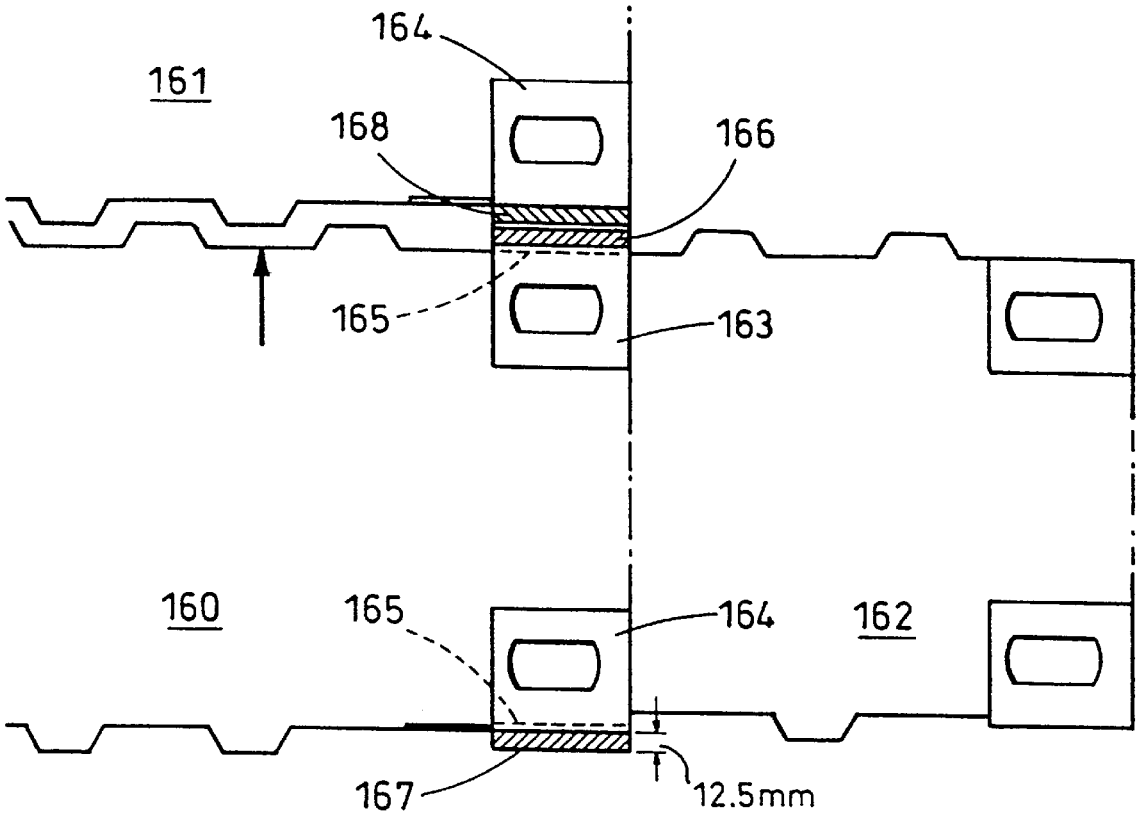
FIG. 16 is a partial plan view of two different length containers stowed side by side.

However, as shown in FIG. 16 one must consider the possibility of one 1372 cm unit stowed beside a 1220 cm unit and in addition to standard intermediate fittings 2 the extreme outer ends of the extension portions of the enlarged container are also provided with corner fittings 2 with a suitable end frame to support them in the usual way.

Moreover, it is essential to maintain the stability of the larger container and therefore handling fittings are provided at the top and bottom of each side of the container to define handling capabilities at a 1220 cm (40 ft) distance centrally spaced intermediate between the ends of the container as indicated in FIG. 16 which is a partial view of a 1370 cm (45 ft) container 160 located adjacent a 1220 cm (40 ft) container 161. An extension 162 of the larger container projects beyond the container 161. To accommodate pallets of an appropriate width within container 164, the outer surface of the posts align with the internal surface of the side walls as indicated by the broken line 165 in FIG. 16.

However, such construction still produces an unstable larger container and it is proposed that to reduce instability two additional elongate plate-like posts structures be fixed by welding, for example, to each of the external surfaces of the posts extending in a vertical direction between each of upper fittings 163, 164 and corresponding lower fittings (not shown). There is a 25 mm gap between the vertical faces of adjacent corner fittings of two containers during normal stowage. Each plate like post 166, 167 on the external side surface of one of the corner fittings is 12.5 mm in thickness, that is half the stowage distance between corner fittings 164, 165. The additional plate is only attached to the respective post between upper and lower fittings and does not cover the fittings to avoid loss of use of the handling aperture through the sidewall of the fittings 163, 164 etc. Moreover, the intermediate space 1220 cm (40 ft) fittings will be similarly constructed to provide the posts between top and bottom fittings with a side plate to increase the thickness of the corner fitting on the outside of the container by 12.5 mm.

Conveniently, container 161 corner fitting 164 is also provided with a strengthening post 168 similarly mounted as strengthening post 166 and 167. In this way the external surfaces of posts 166 and 168 rub together because both being 12.5 mm in thickness they together fill the usually expected gap of 25 mm between corner fittings. Advantageously the rubbing of these rubbing posts 166, 168 during stowage considerably reduces the risks of the side wall corrugations of the containers from contacting one another.

In this way the posts with the additional plate can have an outer surface which will extend further outwards from the side of the container than the surface of the bottom of each corrugation space 27. Conveniently, the post can be constructed relative to the container to project into the cargo space if necessary. Furthermore, the post can be within the plan profile of that corner fitting or can project outside this plan profile if necessary.

Figure 17A:
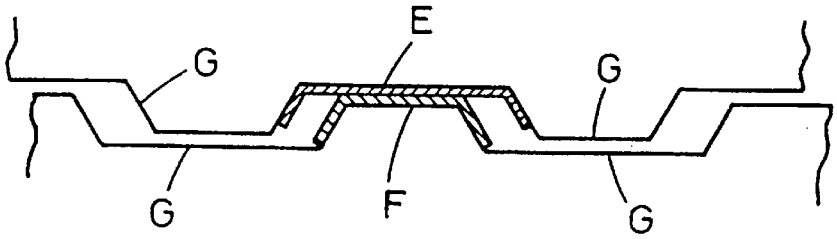
FIGS. 17A and 17B show, respectively, a detailed partial plan view of the side walls of two adjacent stowed containers with wall strengthening.

In a further embodiment shown in detail in FIG. 17A the corrugations are shown to be reinforced in certain areas E,F so that when two containers are adjacent, opposed peaks and recesses are strengthened by additional plates. These strengthening plates advantageously protect the remainder of the thinner steel side wall corrugations G from engaging each other. The thickness of the reinforcements E,F is such that these make contact with each other before the thinner wall sections can touch. The reinforced panels E,F can be made from thicker steel than the side wall thickness (say 3 mm instead of a more general 2 mm), or by adding on rubbing plates, or replacing a thin corrugation with a special post.

Figure 17B:
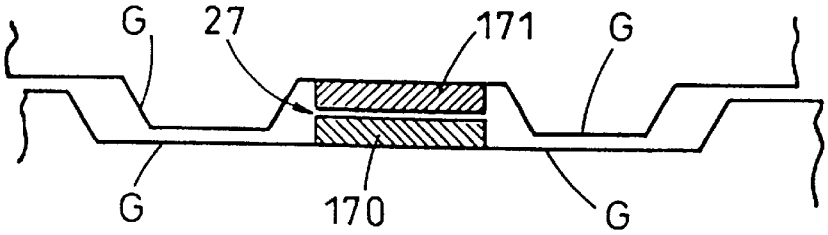

FIG. 17B illustrates an alternative structure in which intermediate the ends of say a 1220 cm (40 ft) container one vertical member is omitted and a strengthening post 170 of elongate rectangular cross-section is located in place of the omitted vertical member. The post 170 extends in a vertical direction on the external surface of the container and can extend the full height of the container or only a small distance as desired. In the embodiment shown in FIG. 17B a similar such strengthening post 171 is located in an aligned space 27 between peaks 22 of the corrugations of two identical containers of a length of 1220 cm (40 ft) so that when stowed one adjacent to the other the posts 170, 171 abut and protect the corrugations against damage whilst strengthening the respective sidewall. Two or more respective posts may be present on each side of a container.

Conveniently, the strengthening post 170 is located centrally of the 1220 cm (40 ft) container. When say two 610 cm (20 ft) containers are located end to end and adjacent the 1220 cm (40 ft) container, the adjacent corner fittings of the two 610 cm (20 ft) containers contact the rubbing strengthening post. The strengthening posts 170, 171 are each of thick steel which can be for example 12.5 m thickness.

I claim:

1. A freight container having a rectangular box shape including supporting posts, each having an outer surface, the outer surfaces of adjacent supporting posts being coplanar with one another and defining a plane therebetween, top and bottom rails joined to said supporting posts and positioned within the planes defined by said supporting posts, a pair of opposed side walls extending longitudinally between adjacent supporting posts and vertically between said top and bottom rails, each side wall having a plurality of longitudinally spaced apart elongate members extending in a vertical direction between said top and bottom rails, said elongate members projecting outwardly beyond said plane defined by said adjacent supporting posts, said elongate members of one wall being provided with spaces between the outwardly extending elongate members of the opposite wall such that the elongate members on one side wall of one container can be interengaged in the spaces of a side wall of an aligned adjoining container, said elongate members having opposing ends projecting outwards beyond respective said top and bottom rails, at least some of said opposing ends having wedge shaped capping means, said wedge shaped capping means extending substantially from said plane adjacent said top and bottom rails to an outer extremity of said elongate member.

2. A container as claimed in claim 1 wherein, at least one outwardly extending vertical member is an integral part of the wall.

3. A container as claimed in claim 1, wherein at least one outwardly extending vertical member is separately attached to the wall.

4. A container as claimed in claim 1, wherein the outwardly extending vertical members are fixed to top and bottom rails of the container.

5. A container as claimed in claim 1, in which the outwardly extending vertical members taper towards at least one of their upper and lower ends.

6. A container as claimed in claim 1, wherein the outwardly extending vertical members terminate at top and bottom rails within said plane.

7. A freight container as claimed in claim 1, wherein said capping means is integral with its respective rail.

8. A container as claimed in claim 7, wherein the capping piece comprises a forged wedge shaped block.

9. A container as claimed in claim 1, wherein the capping piece comprises a plate covering the profile of the vertical member fixed to or formed as part of the top and/or bottom, or side rail.

10. A container as claimed in claim 1, wherein the outwardly extending vertical member partly abuts the top and bottom rails.

11. A container as claimed in claim 1, wherein one of two corner posts is smaller than the other of the corner posts.

12. A container as claimed in claim 1, wherein one corner post is of a slender plate like construction and the other corner post is of an enlarged rectangular structure.

13. A container as claimed in claim 1, wherein one or both door end corner posts have an inner part whose profile does not project substantially into the cargo space within the container and beyond the inner face of the door.

14. A container as claimed in claim 1, wherein seal faces of door end corner posts and end rails include a sloping face located between one surface to another of the door end corner posts and end rails.

15. A container as claimed in claim 1, wherein the top and bottom rails are arranged to project outside the profile of the container and the outwardly extending vertical members project beyond the top and bottom rails.

16. A container as claimed in claim 1, comprising a door hinged to a door end post by a double hinge arrangement.

17. A container as claimed in claim 16, wherein the hinge itself has two pivots, one to pivot the hinge and another to pivot the door relative to the hinge plate to allow the door to be opened and laid adjacent to the outside of the container.

18. A container as claimed in claim 1, wherein the pitch of the corrugation of the walls is selected to minimise the length of a flat zone at each corner post to allow the container to be located in a cell guide of a stowage location.

19. A container as claimed in claim 1, wherein the outwardly extending vertical members of the walls are of a smaller depth in a central intermediate position along the length of the wall than the remainder of the outwardly extending vertical members of that wall.

20. A container as claimed in claim 1, wherein one or more outwardly extending vertical members are removable from an intermediate central location along a wall of the container.

21. A container as claimed in claim 1, wherein the top and bottom rails are set closer together than a standard setting for a container to enable outwardly extending vertical members of a greater depth to extend from the walls of the container.

22. A container as claimed in claim 1, comprising a rubbing strip in the region of the floor of the container for guiding pallets loaded into the container.

23. A container as claimed in claim 22, wherein the rubbing strip is an extension of a bottom rail of the container.

24. A container as claimed in claim 23, wherein a side wall panel of the wall is mounted on an edge of the rubbing strip extension.

25. A container as claimed in claim 1 including strengthening members attached to the external surface of walls of the container, with the strengthening members extending over an outwardly extending vertical member of one wall and on the opposed wall attached to the external surface of a space between outwardly extending vertical members, which space is aligned with the outwardly extending vertical member having the strengthening member attached thereto.

26. A container as claimed in claim 23, wherein an end cap is integrally formed in the side rail.

27. A container as claimed in claim 1, wherein an outer side face of a corner fitting at one end of a container has a buffer plate attached thereto to reduce the width between stowed containers at the corner fittings.

28. A container as claimed in claim 27, wherein a diagonally opposite corner fitting is also provided with a plate for reducing the width between stowed containers.

29. A freight container as claimed in claim 1, wherein said capping means are inserted into said respective opposing ends of said elongate members.

30. A freight container as claimed in claim 1 wherein said capping means is an integral part of an associated elongate member.

* * * * *